United States Patent [19]

Tanji et al.

[11] Patent Number: 4,496,505

[45] Date of Patent: Jan. 29, 1985

[54] PROCESS FOR THE PRODUCTION OF A POLYESTER FIBER DYEABLE UNDER NORMAL PRESSURE

[75] Inventors: Hiroshi Tanji, Fuji; Michitaka Iwata, Minoo; Hideo Sato, Nobeoka, all of Japan

[73] Assignee: Asahi Kasei Kogyo Kabushiki Kaisha, Osaka, Japan

[21] Appl. No.: 527,499

[22] Filed: Aug. 29, 1983

Related U.S. Application Data

[62] Division of Ser. No. 340,895, Jan. 19, 1982, Pat. No. 4,415,726.

[30] Foreign Application Priority Data

Jan. 19, 1981 [JP] Japan ..... 56-5131
Feb. 9, 1981 [JP] Japan ..... 56-16902

[51] Int. Cl.[3] ..... D01D 5/048
[52] U.S. Cl. ..... 264/101; 264/176 F
[58] Field of Search ..... 264/176 F, 103, 78, 264/168, 235, 101

[56] References Cited

U.S. PATENT DOCUMENTS

| | | | |
|---|---|---|---|
| 2,296,202 | 9/1942 | Hardy | 264/168 |
| 2,604,689 | 7/1952 | Hebeler | 264/168 |
| 2,957,747 | 10/1960 | Bowling | 264/168 |
| 3,634,580 | 1/1972 | Watase et al. | 264/235 |
| 4,134,882 | 1/1979 | Frankfort et al. | 264/176 F |
| 4,156,071 | 5/1979 | Knox | 264/210.8 F |
| 4,296,058 | 10/1981 | Chen et al. | 264/78 |
| 4,338,275 | 7/1982 | Carr | 264/176 F |

FOREIGN PATENT DOCUMENTS

| | | | |
|---|---|---|---|
| 53-52721 | 5/1978 | Japan | 264/176 F |
| 53-52722 | 5/1978 | Japan | 264/176 F |

*Primary Examiner*—James Lowe
*Attorney, Agent, or Firm*—Finnegan, Henderson, Farabow, Garrett & Dunner

[57] ABSTRACT

A polyethylene terephthalate fiber capable of being dyed under normal pressure and having an initial modulus of more than 50 g/d, a peak temperature (T max) at peak of dynamic mechanical loss tangent (tan δ) measured with a frequency of 110 Hz of about 85° C. to about 110° C., and a peak value of the dynamic mechanical loss tangent ((tan δ) max) of about 0.115 to about 0.135. The fiber has a sheathcore structure such that refractive indices are different between an outer layer of the fiber and an inner layer of the fiber, and a local average refractive index distributed symmetrically around the center of the cross section of the fiber. The fiber is made by extruding a dope of polyester, passing the extruded filaments through a heating zone provided at the surface of the extrusion nozzle and having a length of at least about 5 cm and a temperature of about 150° C. to about the melting point of the polymer, applying a vacuum with an aspirator located below the heating zone, and then winding at a winding speed of at least about 5,000 m/min.

4 Claims, 7 Drawing Figures

PROCESS FOR THE PRODUCTION OF A POLYESTER FIBER DYEABLE UNDER NORMAL PRESSURE

This is a division of application Ser. No. 340,895, filed Jan. 19, 1982, now U.S. Pat. No. 4,415,726.

BACKGROUND OF THE INVENTION

The present invention relates to improved polyester fibers and a process for their production. More particularly, the invention relates to polyester fibers capable of being dyed under normal pressure and still having sufficient properties for practical use, and to a spinning process for preparing improved polyester fibers possessing improved stability involving spinning an extruded filament at high speed.

Polyester fiber, especially polyester fiber consisting essentially of polyethylene terephthalate, has many excellent properties such as strength and dimensional stability and many varied uses. On the other hand, polyethylene terephthalate fibers are poor in dyeability, and it is therefore necessary to dye them under the conditions of high temperature, e.g., about 130° C., and high pressure. Consequently, the production of such fibers suffers from the disadvantages that a special apparatus is required for dyeing. Moreover, use of such fibers in admixture with fibers such as wool and acrylic fibers, whose physical properties deteriorate upon dyeing under high pressure and high temperature, is limited.

Various improvements in dyeability of polyester fiber under normal pressure have been proposed. A process in which carriers are employed in dyeing, for example, is known. The process has the disadvantages, however, that specific carriers are required and a subsequent treatment with dyeing liquid is difficult.

A copolymer of polyester with a compound having a metal sulfonate group or polyether has been considered a polyethylene terephthalate having improved dyeability. The dye fastness and some of the excellent properties possessed by polyethylene terephthalate inherently deteriorate in such modified polyesters, however, and it is difficult to polymerize and spin them. Consequently, the improvement resulting from such chemical modification detrimentally affects inherent properties of the fiber, as well as improving dyeability, since the improvement is achieved by introducing a third component that can act as a receptacle for dyeing the polymer.

An improvement in dyeability by other than chemical modification also has been proposed. Japanese patent publication (unexamined) No. 64133/1979, for example, discloses a flat yarn and tow prepared by spinning at a relatively high speed of about 4,000 m/min. characterized by denier per filament, intrinsic viscosity [$\eta$], relative dyeing velocity of dispersed dye, modulus, modulus after boiled water treatment, amorphous modulus, shrinkage in boiled water, modulus at shrinking, and shrinkage. The Japanese patent publication discloses only polyester filament or tow having suitable properties making it suitable as a substitute for cellulose acetate fiber, however, i.e., it has a lower modulus and higher elongation than conventional polyester fibers. Furthermore, there is no description of dye fastness in the Japanese patent publication.

U.S. Pat. No. 4,134,882 discloses a polyester fiber improved in dyeability having a long period of about 300Å or more and a difference of birefringence index between that of an inner layer of fiber and that of an outer layer of fiber of less than about $10\times10^{-3}$. The fiber is prepared by spinning at extremely high speeds of 6,000 to 8,000 yard/min. (5,400 to 7,200 m/min.). When the fiber described in the patent is dyed under normal pressure, however, it takes a long time to attain a balanced dye absorption. Thus, the fiber does not have suitable dyeability under normal pressure for commercial use.

Japanese patent publication (unexamined) No. 107511/1980 discloses a process for preparing a polyethylene terephthalate fiber having a section average birefringence ($\Delta n$) of $90\times10^{-3}$ or more and a double structure at a section of the fiber, i.e., there is some difference in birefringence at a section of fiber between an outer layer of fiber and an inner layer thereof. Japanese patent publication (unexamined) No. 107511/1980 also points out that the fiber has mechanical properties similar to that of conventional polyethylene terephthalate fiber, viz. natural crimp and good absorption of dye. Such natural crimp, however, is insufficient for practical use and, moreover, causes lower process efficiency upon subsequent processing and a lower quality of knitted and woven fabric. Japanese patent publication (unexamined) No. 107511/1980 not only discloses and teaches a specific structure of fiber, but also a dyeability under normal pressure, and an effect related to dye fastness. Thus, the fiber of the present invention, which is capable of being dyed under normal pressure, cannot be prepared by the process described in the Japanese patent publication.

It has been disclosed that a fiber having properties adequate for practical use can be prepared by a spinning process comprising extruding a melt of polyester and spinning at high speed in Japanese patent publication (examined) No. 3104/1960, Japanese patent publication (unexamined) No. 107511/1980, and Seni Gakkai-shi 33 T208 to T214 (1977). With respect to the disclosure of polyethylene terephthalate fiber in these publications, the fiber prepared by spinning at about 5,000 m/min. or more is very similar to a conventional stretched fiber. It has been clear from studies that spinning at high speed, especially 5,000 m/min. or more, causes breaking of the filament and fiber during the spinning process and lowers spinning stability, i.e., lowers operating efficiency. This tendency increases with lower filament denier and an increase in the number of filaments.

When a polyester fiber had a filament denier of 0.5 d to 5 d and a number of filaments of 10 or more, for example, it was very difficult to spin at 6,000 m/min. or more. We have studied conditions of spinning such as viscosity of polymer, spinning temperature, spinning draw-ratio, and condition of cooling air in order to improve spinning stability at high speed spinning. We found that it was impossible to increase spinning stability by varying these conditions.

On the other hand, Japanese patent publication (examined) No. 13156/1960 discloses a process for controlling orientation of filaments by providing a heating zone substantially contacting a nozzle. Although this process permits improvement of properties such as strength and elongation, spinning stability, especially spinning stability at high speed spinning, remains a problem.

Japanese patent publication (unexamined) No. 151611/1979 discloses a process comprising subjecting a filament extruded from a nozzle to suction or a vacuum with an aspirator and then winding with a winding device. The purpose of the Japanese patent publication is to avoid raising the tension of a filament during spinning, which is caused by air resistance. A process for accumulating filaments on a conveyor net also has been known as a spun-bond process. In the process, an aspirator is employed instead of a godet roll or winder. These two processes do not teach an improvement in stability of spinning and prevention of breaking of fibers and filaments.

SUMMARY OF THE INVENTION

An object of the present invention is to provide a polyester fiber consisting essentially of polyethylene terephthalate, capable of being dyed under normal pressure.

Another object of the present invention is to provide a process for producing a polyester fiber with improved spinning stability at high spinning speed.

Additional objects and advantages of the invention will be set forth in the description that follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the polyester fiber of the present invention consists essentially of polyethylene terephthalate capable of being dyed under normal pressure and having an initial modulus of more than about 50 g/d, a peak temperature (T max) at peak of dynamic mechanical loss tangent (tan δ) measured with a frequency of 110 Hz of about 85° C. to about 100° C., a peak value of the dynamic mechanical loss tangent ( (tan δ) max ) of about 0.115 to about 0.135, and a local average refractive index distributed symmetrically around the center of the cross section of the fiber.

Further to achieve the foregoing objects and in accordance with the purpose of the invention, as embodied and broadly described herein, the process of the present invention for producing a polyester fiber comprises extruding a melt of polyester, passing the extruded filaments through a heating zone provided at the surface of the nozzle and having a length of at least about 5 cm and a temperature of about 150° C. to about the melting point of the polyester, applying a vacuum with an aspirator located below the heating zone, and then winding at a speed of at least about 5,000 m/min.

The accompanying drawings, which are incorporated in and constitute a part of this specification, illustrate the invention and, together with the description, serve to explain the principles of the invention.

DESCRIPTION OF THE PREFERRED EMBODIMENTS

Figure 1:
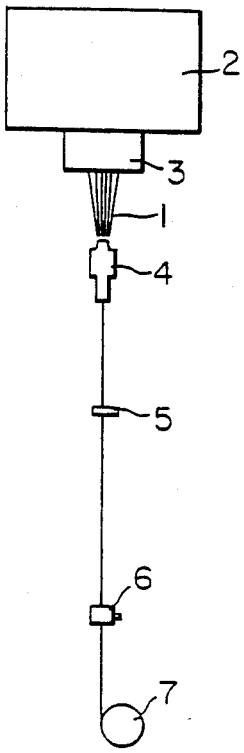
FIG. 1 is a diagram illustrating one embodiment of an apparatus employed in the process of the present invention, in which the numbered elements are as follows: 1, extruded filaments; 2, a spinhead with a nozzle; 3, a heating cylinder; 4, aspirator; 5, a device for a lubricating treatment; 6, a device for entangling; 7, a godet roll or winder.

Reference will now be made in detail to the presently preferred embodiments of the invention, examples of which are illustrated in the accompanying drawings.

As a result of a study on the microstructure of polyester fiber, it has been found that only a polyester fiber having a specific amorphous structure could overcome the disadvantages of conventional fibers. And only a polyester fiber having a specific amorphous structure has an excellent dyeability, especially a dyeability under normal pressure, and an excellent dye fastness in addition to the suitable inherent properties of polyester fibers.

Furthermore, it has been found that spinning stability at high speed spinning could be improved by a specific process comprising subjecting extruded filaments to a vacuum or suction with an aspirator provided below the nozzle and spinning at specific speed.

By spinning at the specific spinning speed, the fiber prepared can have a novel microstructure and can be dyed under normal pressure. By using an aspirator, the fiber has adequate properties for practical use and good dyeability. Moreover, it has been found that when the filaments pass through a heating zone provided at the surface of the nozzle having a specific length and a specific temperature before being subjected to a vacuum, the efficiency and stability of spinning at high speed spinning increase remarkably.

Polyesters polymerized by known processes can be employed in the present invention. Preferably a polyester consisting essentially of polyethylene terephthalate is employed. Known additives for polyesters such as a delustering agent, a stabilizer, and an antistatic agent can be added to the polyester. The intrinsic viscosity of the polyester used in the present invention is not limited in scope because of the fiber to be formed. In view of the desired stability of spinning and properties of the fiber, the intrinsic viscosity of the polyester preferably is in the range of about 0.48 to about 1.0. A copolymer of a polyester with a small amount of comonomer may be employed within the scope of the present invention.

A polyester fiber of the present invention is characterized by a peak temperature (T max) at peak of dynamic mechanical loss tangent (tan δ) measured with a frequency of 110 Hz of about 85° to about 110° C. and a peak value of dynamic mechanical loss tangent ( (tan δ)max ) of about 0.115 to about 0.135. When the T max is more than about 110° C., dyeability decreases and the fiber cannot be dyed under normal pressure. When the T max is less than about 85° C., the fiber does not have adequate mechanical properties for practical use. On the other hand, when the (tan δ) max is more than 0.135, heat stability, dimensional stability, and dye fastness of the fiber decrease. When the (tan δ) max is less than 0.115, dyeability of the fiber decreases and the fiber cannot be dyed under normal pressure. A conventional polyester fiber has a T max of 120° C. or more, and generally its (tan δ) max increases when the T max decreases. Consequently, a polyester fiber having the combination of dyeability, dye fastness, and heat stability has never previously been known.

In the present invention, the initial modulus at 30° C. preferably is in the range of about 50 g/d to 100 g/d in order to achieve the inherent properties of polyester. For the same reason, the birefringence index (Δn) in the present invention is preferably about $30\times10^{-3}$ or more. The initial modulus at 30° C. in the present invention is represented by a dynamic elasticity at 30° C. (E'30). When the average refractive index ($n_{\parallel(0)}$) at the center of a fiber by polarized light having an electric field vector in the direction of the axis of a fiber is in a preferred range of about 1.65 to about 1.70, the fiber has a suitable elongation (about 20% to about 60%) and dyeability. Such a fiber is desirable for use in forming cloth.

Furthermore, when the difference of average refractive index ($\Delta_{\parallel(0.8-0)}$) between average refractive index ($n_{\parallel(0)}$) and refractive index at a position 0.8 times from the center of the cross section of a fiber ($n_{\parallel(0.8)}$) is within the preferred range of about $10\times10^{-3}$ to about $80\times10^{-3}$, more preferably about $10\times10^{-3}$ to about $40\times10^{-3}$, and the local average refractive index is distributed symmetrically around the center of the cross section of the fiber, the fiber has sufficient strength and is also improved in uniformity of dye, strength, and elongation and does not have a natural crimp.

Consequently, subsequent processing can be conducted at high process efficiency, and the quality of knitted and woven fabric formed from the fiber is high.

A local average refractive index distributed symmetrically around the center of the cross section of a fiber means that the minimum value of the average refractive index ($n_{\parallel}$) is about ($n_{\parallel(0)}-10\times10^{-3}$) or more, that the $n_{\parallel}$ is a minimum at a distance of 0.15 times the radius from the center of the fiber (0.15 ~ −0.15), and that the difference between $n_{\parallel(-0.8)}$ and $n_{\parallel(0.8)}$ is about $10\times10^{-3}$ or less. Values of $n_{\parallel(0)}$, $n_{\parallel(0.8)}$, $n_{\parallel(-0.8)}$, $\Delta_{\parallel(0.8-0)}'$ and Δn hereinbefore mentioned are measured by methods using an interference microscope discussed below.

Crystallinity (Xc), apparent crystallite size at the (010) face (ACS), and crystal orientation at the (010) face (Co) are all related to mechanical properties of the fiber. In the present invention, the Xc is preferably in the range of about 70% to about 85%, more preferably about 75% to about 85%, the ACS is preferably in the range of about 50 Å to about 75 Å, more preferably about 55 Å to about 75 Å, and the Co is preferably in the range of about 90% to about 98%, more preferably about 94% to about 98%, so that the fiber of the present invention has suitable properties for a polyester fiber such as a strength of about 3 g/d or more, an elongation of about 20% to about 60%, and an initial modulus of about 50 g/d to about 100 g/d. The orientation angle (H) is preferably 94% or more. The Xc, ACS, and Co of the present invention are measured by X-ray diffraction discussed below.

The average birefringence (Δn) of the present invention is preferably about $30\times10^{-3}$ or more so that the fiber has an initial modulus at 30° C. of about 50 g/d to about 100 g/d. For purposes of heat stability, dyeability, and dye fastness, the Δn is preferably about $110\times10^{-3}$ or less, more preferably about $85\times10^{-3}$ or less. When the Δn is about $110\times10^{-3}$ or less, the rate of decrease of dynamic elasticity (E') at between 150° C. and 220° C., represented as E'220/E'150: E'220, (E') at 220° C.; E'150, (E') at 150° C., becomes 0.75 or more, i.e., the structure of the fiber is stabilized against heat, and dye fastness increases. Furthermore when the Δn is about $85\times10^{-3}$ or less, dyeability under normal pressure is greatly improved.

In the present invention, when dynamic mechanical loss tangent at 220° C. (tan δ 220) is small, the initial modulus does not decrease with elevating temperature. Especially when the tan δ 220 is about 0.025 or less, the decrease of initial modulus becomes remarkably small.

The fiber of the present invention is prepared by a high speed spinning process of at least about 5,000 m/min., for example at 7,000 m/min. or more, preferably 7,300 m/min. or more. In the present invention, a fiber having desirable properties is preferably prepared with good efficiency and stability of spinning at high speed spinning when cooling and solidification and dimensional transformation of polymer extruded from a nozzle are controlled by regulating conditions such as polymer viscosity, spinning temperature, conditions of the atmosphere below the nozzle, the method for cooling filaments, and the speed of spinning. It is important to control the cooling and solidification of extruded filaments, especially since sudden cooling and solidification of extruded filaments and cooling and solidification by use of cooling air having a low temperature in a single direction crossing at a right angle to the filament, are not preferable to achieve good spinning efficiency and desirable properties. Sudden cooling and solidification at a low temperature of 0° C. or less should be avoided because such cooling and solidification cause an unsymmetrical distribution of local refractive index at a cross section of the fiber and natural crimp.

The spinning speed of the present invention is defined as that of the first godet roll or winding speed in the case of godetless process by which a cooled and solidified filament is wound after an entangling process and a lubrication treatment, if necessary. According to the process of the present invention, a high speed spinning process can be conducted stably at about 5,000 m/min. or more. More preferably, a process of spinning at about 7,000 m/min. or more can prepare the polyester fiber of the present invention capable of being dyed under normal pressure.

Polyesters that can be employed in the process of the present invention are polyesters that are polymerized by known processes, for example, polyethylene terephthalate, polybutylene terephthalate, polypropylene terephthalate, polyhexamethylene terephthalate, polyethylene-2,6-naphthalate, polyethylene-2,2'-diphenoxyethane-4,4'-dicarboxylate, etc. A copolymer of the polyester that is copolymerized with a small amount of comonomer may also be employed.

It is preferred in the process of the present invention that an extruded filament passes through a heating zone maintained at a temperature of about 150° C. to about the melting point of the polyester, preferably about 150° C. to about a temperature below 15° C. from the melting point of the polyester, and having a length of at least about 5 cm from the surface of the nozzle.

The heating zone of the present invention can be formed, for example, by providing circular heating apparatus having a suitable inside diameter depending on the arrangement of fine holes on the surface of the nozzle. Known heaters can be employed in the circular heating apparatus, but an electric heater is preferred in terms of efficiency. Instead, the heating zone can be supplied with a heated fluid in an area of about 5 cm or more below the surface of the nozzle, or it can be a cylindrical tube attached to the surface of the nozzle, which in turn heats the fluid within the tube. The length of the heating zone must be at least about 5 cm. When it is less than about 5 cm, spinning cannot be carried out stably under high speed winding. The upper limit of the length of the heating zone is not particularly critical. A length of about 100 cm or less is preferred, however, in terms of cost of equipment and performance.

The most preferred length of the heating zone is, however, depending on spinning conditions such as spinning temperature and denier of filament, about 20 cm to about 100 cm. The atmosphere in the heating zone can be air, nitrogen, steam, etc. Generally air is preferred. The temperature of the atmosphere must be about 150° C. to about the melting point of polyester. When the temperature of the heating zone is less than about 150° C., the annealing effect is insufficient and stable spinning cannot be carried out under high speed spinning. When the temperature of the heating zone is more than about the melting point of the polyester, the filaments stick together and vibrate, and therefore the spinning stability decreases. The temperature of about 150° C. to a temperature below 15° C. from the melting point of the polyester is preferred. The temperature of the heating zone of the present invention means the temperature in the neighborhood of the filaments in the heating zone. The heating zone enhances the operability of a commercial process and high spinning stability and efficiency.

An important element of the process of the present invention is that the filaments are subjected to a vacuum or suction applied by an aspirator. As the aspirator of the present invention, apparatus that can generate a stream in a direction parallel to the running filament can be employed.

Figure 2:
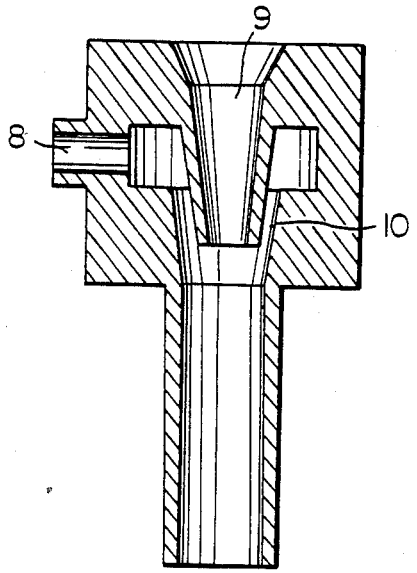
FIG. 2 is a vertical section of one embodiment of the aspirator of the present invention, in which the numbered elements are as follows: 8, a hole for supplying compressed fluid; 9, a hole for introducing filaments; 10, a hole for introducing fluid.

For example, the aspirator described in Japanese patent publication (unexamined) No. 151611/1979 can be employed. One embodiment of an aspirator that can be used in the present invention is shown in FIG. 2. The filaments introduced through hole 9 are pulled by suction from the compressed fluid introduced through hole 10. The distance between the heating zone and the aspirator is determined by spinning conditions such as the amount of polymer extruded, the number of filaments, the temperature of the heating zone, and the spinning speed. When it is too short, the filaments stick together at the aspirator. On the other hand, when it is too long, a high pressure and a high flux are required to obtain sufficient effect from the aspirator. Therefore, the distance between the heating zone and the aspirator is preferably about 5 cm to about 60 cm, more preferably about 10 cm to about 40 cm.

Various fluids can be supplied to the aspirator, e.g., air, nitrogen, and steam, but generally air is preferred. The pressure and flux of the fluid are determined by the denier of the filament, the number of filaments, and the spinning speed. It is preferred, however, to give the filaments a velocity of more than one tenth of the spinning speed. The velocity that filaments are given by the aspirator is calculated from the denier of filaments passed through the aspirator and the amount of polymer extruded.

The temperature of the fluid is preferably room temperature or higher. Fluid having an extremely low temperature probably results in inferior properties and also detrimentally affects cost.

The fluid of the aspirator is supplied from the circumferential direction of the filament and in a direction parallel to the running filament. Use of both the heating zone and the aspirator in the process of the present invention achieves high spinning efficiency and stability at high speed spinning.

In the next step of the present invention, the filament leaving the aspirator is wound at a speed of at least about 5,000 m/min., preferably less than about 12,000 m/min., more preferably about 6,000 m/min. to about 10,000 m/min., and still more preferably 7,300 m/min. to about 10,000 m/min.

When the spinning speed is 5,000 m/min. or less, the properties of the fiber such as strength, elongation, initial modulus, shrinkage, etc., are inadequate for practical use. An especially excellent fiber having no natural crimp and good dyeability under normal pressure is prepared at a spinning speed of 7,000 m/min. or more. On the other hand, when the spinning speed is over 12,000 m/min., a suitable fiber is not prepared, because filaments break easily even though other conditions are within preferred ranges.

If necessary, a conventional cooling device using cooled air can be employed between the heating zone and the aspirator, or after the aspirator in the present invention. The aspirator also can serve as a cooling device when a cooling device is not provided.

When the filaments are spinned, a known lubrication treatment (as described in Japanese patent publication (examined) No. 21925/1966), and if necessary a known entangling treatment (as described in U.S. Pat. No. 2,985,995) can be carried out at a suitable location between the aspirator and the winder. The winder that can be used in the present invention can be, for example, a high speed winder described in Seni Gakkai-shi 33 No. 5, T209.

The fiber of the present invention can be used as a filament itself. Furthermore, the fiber can be subjected to false twisting or texturizing by fluid. The fiber also can be knitted or woven alone or mixed with other fibers. The staple fiber that is made from the fiber of the present invention can be used as a spun yarn or a mixed yarn.

Furthermore, the fiber of the present invention has excellent dye fastness as well as excellent dyeability under normal pressure at 100° C. The fiber of the present invention has a specific microstructure so that even when the fiber is heated in a process for manufacturing fabrics, the structure barely changes.

The fiber of the present invention may be highly efficiently processed during subsequent processing. Furthermore, since the knitted and woven fabric prepared from the fiber of the present invention has high quality, the fiber of the present invention is useful for cloth.

The process of the present invention makes it possible to conduct stable spinning at high speed spinning of at least about 5,000 m/min. to about 12,000 m/min., which was extremely difficult to do previously. According to the present invention, polyester fiber has adequate properties for practical use such as strength, elongation, Young's modulus, shrinkage, etc.

METHODS FOR MEASURING PARAMETERS TO BE USED FOR SPECIFYING THE STRUCTURAL PROPERTIES OF THE PRESENT INVENTION

A. Dynamic Mechanical Loss Tangent (tan δ) and the Dynamic Elasticity (E')

The dynamic mechanical loss tangent (tan δ) and the dynamic elasticity (E') can be measured by using the apparatus for measuring dynamic elasticity manufactured by Toyo Baldwin, Rheo-Vibron DDV-IIc, at a frequency of 110 Hz, in dry air and at a temperature increasing at the rate of 10° C./min.

Figure 3A:
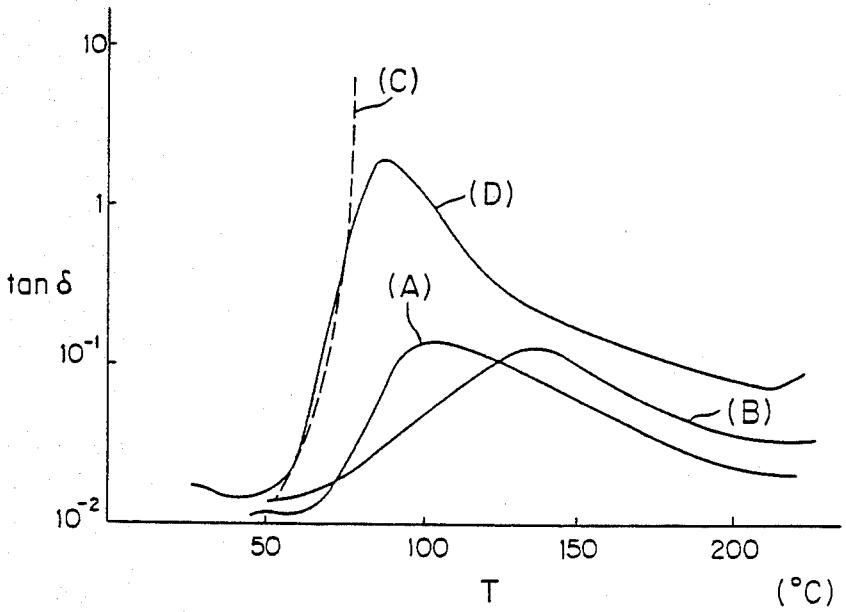
FIGS. 3(*a*) and 3(*b*) are graphs illustrating a dynamic mechanical loss tangent (tan δ) - temperature (T) curve and a dynamic elasticity (E') - temperature (T) curve, respectively.
Figure 3B:
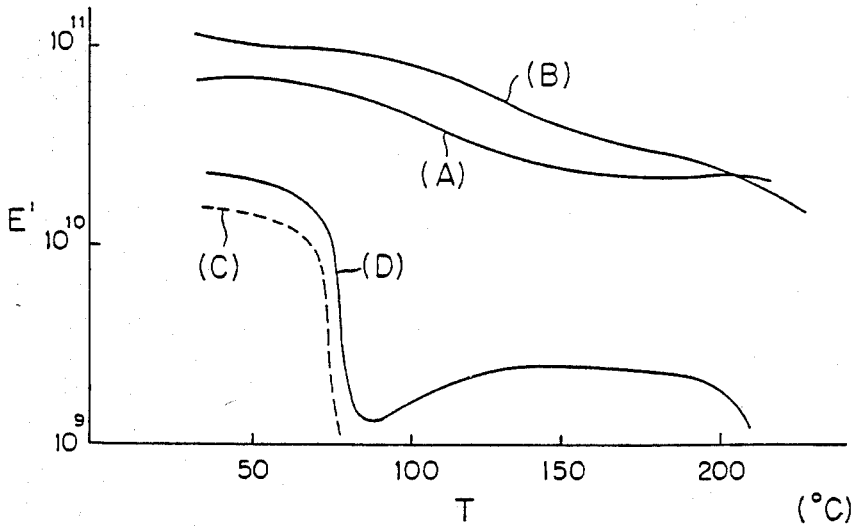

The peak temperature of tan δ (T max) and the peak value of tan δ ((tan δ) max) are given from the tan δ-temperature curve. Typical embodiments of a tan δ-temperature curve and an E'- temperature curve are illustrated in FIG. 3, wherein (A) represents a fiber of the present invention, (B) represents a conventional stretched fiber, (C) represents an unstretched fiber, and (D) represents a partially oriented fiber.

B. Average Refractive Index ($n_{\parallel}$, $n_{\perp}$) and Average Birefringence Index (Δn)

According to the interference fringe method using a transmission quantitative type interference microscope (for example, an interference microscope "Interphako" manufactured by Carl-Zeiss Yena Co., East Germany), the distribution of the average refractive index, observed from the side face of the fiber, can be determined. This method can be applied to fibers having a circular cross section.

The refractive index of fibers is characterized by a refractive index to polarized light vibrating in the direction parallel to the fiber axis ($n_{\parallel}$) and a refractive index to polarized light vibrating in the direction perpendicular to the fiber axis.

Refractive indices ($n_{\parallel}$ and $n_{\perp}$) obtained by using green radiation (wavelength $\lambda=546$ mμ) are employed. The fiber to be tested is immersed in a medium inert to fibers having a refractive index (n) giving a deviation of the interference fringe in the range of 0.2 to 2.0 times the wavelength by using optionally flat slide glass and cover glass.

The refractive index (n) of the medium is a value measured at 20° C. by an Abbe refractometer using green radiation (wavelength $\lambda=546$ mμ).

Several filaments are immersed in the medium so that the filaments are not in contact with one another. The fiber should be disposed so that the fiber axis is perpendicular to the optical axis of the interference microscope and the interference fringe. The pattern of the interference fringe is photographed and enlarged at about 1,500 magnifications for analysis.

Figure 4:
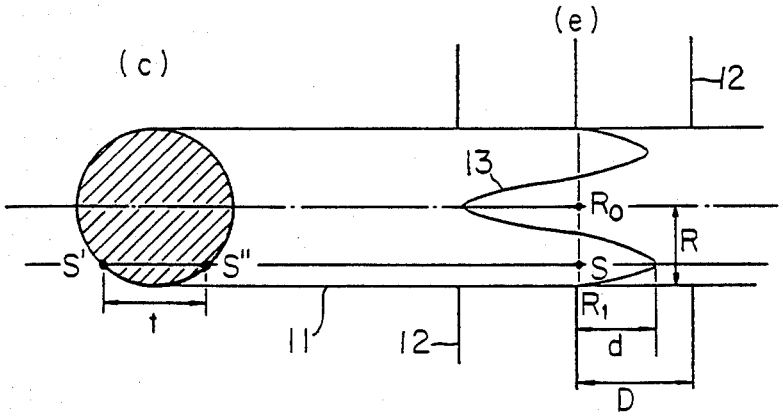
FIG. 4 is one embodiment of a pattern of interference fringe that was used to measure a distribution of a refractive index ($n_{\parallel}$ or $n_{\perp}$) in the direction of a radius of a cross section of a fiber, in which (c) is a cross section of a fiber and (e) is a pattern of an interference fringe in which the numbered elements are as follows: 11, a fiber; 12, an interference fringe by a medium; 13, an interference fringe by a fiber.

Referring to FIG. 4, the optical path difference R is represented by the formula $$R = \frac{d}{D}\lambda = (n_{\parallel}\ (\text{or } n_{\perp}) - n)t$$

wherein n is the refractive index of the medium, $n_{\parallel}$ (or $n_{\perp}$) is the refractive index between $S^{I}-S^{II}$ at the fiber, t is the thickness between $S^{I}-S^{II}$, λ is the wavelength of the radiation used, D is the distance (corresponding to 1λ) between parallel interference fringes of the background, and d is the deviation of the interference fringe by the fiber.

From optical path differences at respective positions in the range of the center of the fiber (Ro) to the periphery of the fiber (R), the distribution of the refractive index $n_{\parallel}$ (or $n_{\perp}$) of the fiber at the respective positions can be determined. When r is the distance from the center of the fiber to the respective position, the refractive index at the center of the fiber, i.e., $X=r/R=0$ is defined as the average refractive index ($n_{\parallel(0)}$ or $n_{\perp(0)}$). X is 1 at the position of the periphery of the fiber, but X is a value of 0 to 1 at the other position of the fiber.

Figure 5:
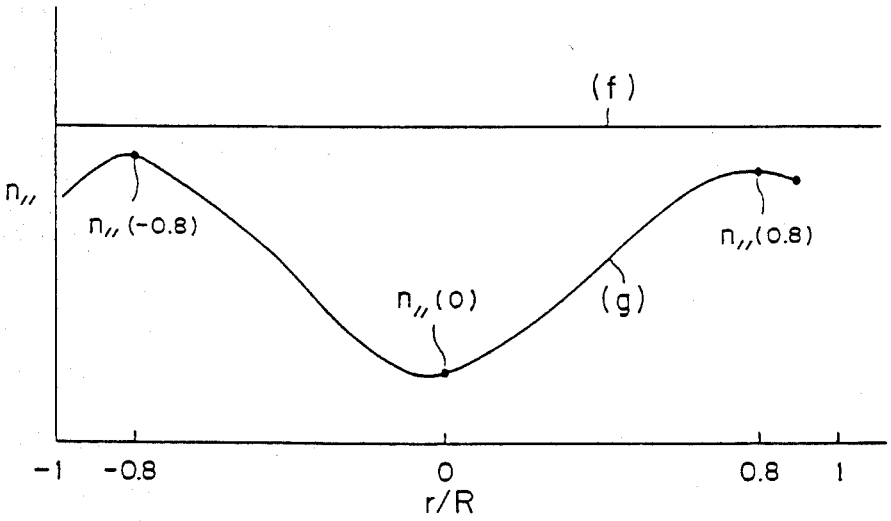
FIG. 5 is a graph illustrating embodiments of distributions of refractive indices ($n_{\parallel}$) in the direction of radii of fibers of the present invention (g) and conventional fibers (f).

For example, $n_{\parallel(0.8)}$ (or $n_{\perp(0.8)}$) represents the refractive index at the position of $X=0.8$. From the average refractive indices $n_{\parallel(0)}$ and $n_{\perp(0)}$, the average birefringence index (Δn) is represented as $\Delta n=n_{\parallel(0)}-n_{\perp(0)}$. The distribution of $n_{\parallel}$ of the conventional stretched fiber (f) and $n_{\parallel}$ of the present invention (g) is shown at FIG. 5, wherein the horizontal axis represents the distance from the center of the fiber, i.e., $X=r/R$, and the vertical axis represents $n_{\parallel}$ $X=0$ is the center of the fiber; $X=1$ or $X=-1$ is the position at the periphery of the fiber.

C. Apparent Crystallite Size (ACS)

ACS can be determined by measuring the X-ray diffraction intensity in the equatorial direction by the reflection method. The measurement is carried out by using an X-ray generator (RU-200PL manufactured by Rigaku Denki), a goniometer (SG-9R manufactured by Rigaku Denki) and a scintillation counter. Cu-Kα (wavelength $\lambda=1.5418$ Å) monochromatized by a nickel filter is used for the measurement. The fiber sample is set in a sample holder composed of aluminum so that the fiber axis is perpendicular to the plane of the 2θ axis of the diffraction meter. The thickness of the sample is adjusted to about 0.5 mm.

The X-ray generator is operated at 30 kV and 80 mA. The diffraction intensity is recorded from 7° to 35° of 2θ at a scanning speed of 1°/min., a chart speed of 10 m/min., a time constant of 1 second with a divergent slit of ½°, a receiving slit of 0.3 mm, and a scattering slit of ½°. The full scale deflection of the recorder is set so that the entire diffraction curve remains on the scale and the maximum intensity value exceeds 50% of the full scale.

Generally, polyethylene terephthalate fiber has three major reflections on the equatorial line in the range of from 17° to 26° of 2θ (at faces of (100), (010), and (110)).

For example, ACS is determined according to the equation of Scherrer described in L. E. Alexander, X-ray diffraction, Chapter 7, published by Kagaku Dojin Shuppan.

A base line is established by drawing a straight line between 7° and 35° of 2θ on the diffraction intensity curve. A vertical straight line is dropped from the diffraction peak, and the mid-point between the peak and the base line is marked. A horizontal line passing through the mid-point is drawn on the diffraction intensity curve. If the two major reflections are sufficiently separated from each other, this line intersects shoulders of the two peaks of the curve, but if they are not sufficiently separated, the line intersects one shoulder alone. The width of the peak is measured. If the line intersects one shoulder alone, the distance between the intersecting point and the mid-point is measured and doubled. If the line intersects two shoulders, the distance between the two shoulders is measured. The measured value is converted to a line breadth in radians and the line breadth is corrected according to the formula:

$$\beta = \sqrt{B^2 - b^2}$$

wherein B is the observed value width, and b is the broadening constant in radians, which is determined by the half value width of the reflection peak of a silicon single crystal at the face (111) thereof.

The apparent crystallite size is given by the formula:

$$ACS\ (Å) = K \cdot \lambda / \beta \cos \theta$$

wherein K is taken as one, $\lambda$ is the X-ray wavelength (1.5418 Å), $\beta$ is the corrected line width, and $\theta$ is the Bragg angle (half of $2\theta$).

D. Degree of Crystallinity (Xc)

Figure 6:
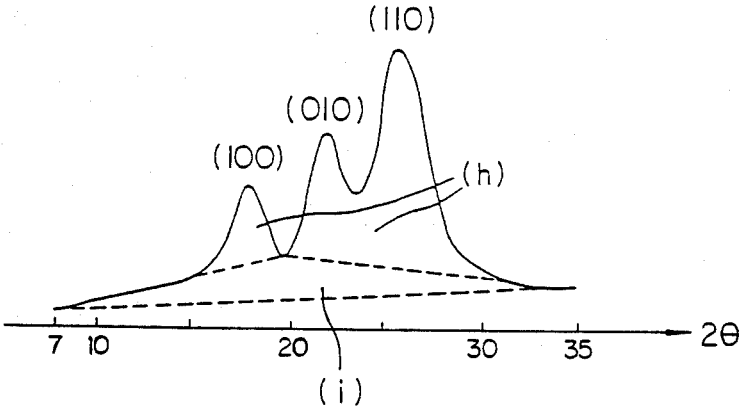
FIG. 6 is a graph of one embodiment illustrating a curve of X-ray diffraction intensity of polyethylene terephthalate fiber, in which, (h) represents a crystalline portion and (i) represents an amorphous portion.

A base line is established by drawing a straight line between 7° and 35° of $2\theta$ on the diffraction intensity curve, which is derived by the same method used to measure ACS. As shown in FIG. 6, the crystalline portion and the amorphous portion are separated by drawing a straight line along the tail of the lower angle and the tail of the higher angle from the peak point positioned near the angle of 20°. Xc is given by an area analysis method according to the formula:

$$Xc = \frac{\text{Scattering intensity of the crystalline portion}}{\text{Total scattering intensity}} \times 100$$

E. Crystalline Orientation (Co)

The degree of crystalline orientation is measured by using an X-ray generator (for example RU-200PL manufactured by Rigaku Denki), a fiber measuring device (FS-3 manufactured by Rigaku Denki), a goniometer (SG-9 manufactured by Rigaku Denki), a scintillation counter, and a pulse height analyzer.

Cu-K$\alpha$ ($\lambda$=1.5418 Å) monochromatized by a nickel filter is used for the measurement. Generally, although a polyethylene terephthalate fiber has three major reflections on the equatorial line, the reflection at the (010) face is used in the measurement of Co. The $2\theta$ value of the reflection of the (010) face used is determined from the curve of the diffraction intensity in the equatorial direction.

The X-ray generator is operated at 30 kV and 80 mA. The fiber sample is attached to the fiber measuring device so that filaments are parallel to one another.

Preferably the sample thickness is about 0.5 mm. The goniometer is set at the $2\theta$ value determined by the diffraction intensity curve in the equatorial direction. Scanning is conducted in the range of from −30° to +30° in the azimuthal direction according to a method of transmission, and the diffraction intensity is recorded by the scintillation counter. Furthermore, the diffraction intensity at −180° and the diffraction intensity at +180° are recorded. At this measurement, the scanning speed is 4°/min., the chart speed is 10 mm/min., the time constant is 1 second, the collimeter is characterized by 2 mm$\theta$, and the receiving slit has a length of 19 mm and a width of 3.5 mm.

The Co value is determined from the obtained diffraction intensity curve in the azimuthal direction according to the following procedures. An average value of the diffraction intensity value obtained at ±180° is evaluated, and a horizontal line (a base line) is drawn to pass through the point of the average value. A perpendicular line is drawn to the base line from the peak, and the mid-point of the perpendicular line is determined and a horizontal line passing through the mid-point is drawn. The distance between two intersecting points of the horizontal line and the diffraction intensity curve is measured and the measured value is converted to an orientation angle H(°) in degrees (°). The degree of crystalline orientation (Co) is given by the formula:

$$Co\ (\%) = \frac{180° - H}{180} \times 100$$

F. Dyeability

The dyeability is evaluated by a balanced dye absorption. A sample is dyed with a disperse dye (Resolin Blue FBL, Tradename of Bayer) at a dye concentration of 3% owf and a bath ratio of 1 to 50 at 100° C. Further dispersing agent (Disper TL) of 1 g/l was added to the dyeing solution, and then acetic acid was added to condition pH of the solution to 6. Dye absorption (%) is calculated as follows:

After two hours of dyeing, part of the dyeing solution was collected and the amount of dye remaining in the dyeing solution was measured by absorbance. Then the amount of dye absorbed is obtained by subtracting the remaining amount of dye from the amount of dye employed in dyeing. The dye absorption is calculated by dividing this absorbed amount of dye by the amount of dye employed and multiplying the result by 100.

The sample is a knitted fabric prepared by simple feeding which is scoured with Scourrol FC of 2 g/l at 60° C. for 20 minutes, dried, and conditioned 65% RH at 20° C.

G. Dye Fastness

The sample is dyed by the same method as that used in the evaluation of dyeability described above except the concentration of dye is 1% owf and dyeing time is 90 minutes. Further, the sample is reduced and washed with hydrosulfate of 1 g/l, sodium hydroxide of 1 g/l, and a surface active agent (Sunmol RC-700) of 1 g/l at a bath ratio of 1 to 50 at 80° C. for 20 minutes.

The samples are evaluated according to JIS-L-1044 on the light fastness, JIS-L-0849 on the friction fastness, and JIS-L-0850 on the hot pressing fastness. The judgment of these evaluations is given by 5 grades, from 1 for the lowest to 5 for the highest, and determined by examination with the naked eye.

H. Initial Modulus

Initial Modulus is the value of the dynamic elasticity (E′) at 30° C., except that of Example 14.

Initial Modulus of Example 14 is measured by the same method as that of "Tenacity and Elongation."

I. Tenacity and Elongation

Tenacity and Elongation are measured using a tensile testing machine, Tensilon UTM-II-20 manufactured by Toyo Baldwin, at an initial length of 5 cm and a tensile velocity of 20 mm/min.

J. Shrinkage with Boiling Water

Shrinkage with boiling water is given by the formula:

$$\text{Shrinkage with boiling water (\%)} = \frac{L_o - L}{L} \times 100$$

wherein $L_o$ is the length of a sample under the load of 1 g/l, and L is the length of the sample under the initial load of 1 g/l after the treatment in the boiling water without the load for 30 minutes.

The present invention is described in detail by the following examples.

EXAMPLES 1 TO 7

Polyethylene terephthalate having an intrinsic viscosity [η] of 0.63, which is measured in a mixed solution of 1:2 volume ratio of phenol and tetrachloroethane, was extruded from a nozzle having 7 fine holes 0.35 mm at a spinning temperature of 300° C. The filaments extruded were cooled and solidified with a stream of air at 22° C. supplied from the direction of the circumference of the fiber in the parallel direction of the running filament and then, after adding a finishing agent, the filaments were spun at a speed of 3,000 m/min. to 9,000 m/min. Finally, the fiber of 35 d/7 f was prepared.

The features of microstructure and properties of the fiber are shown in Table 1. Examples 1 to 3 in Table 1 represent the present invention; Examples 4 to 7 are comparative examples.

EXAMPLE 8

Polyethylene terephthalate having an intrinsic viscosity [η] of 0.63 was extruded from a nozzle having 36 fine holes 0.35 mmϕ. The filaments extruded were cooled and solidified with a stream of air at 22° C. supplied from one direction perpendicular to the filaments, and then the filaments were spun at 1,500 m/min. The fiber of 255 d/36 f prepared was stretched at a stretching temperature of 160° C. Finally the stretched fiber of 75 d/36 f was prepared. The features of microstructure and properties of the stretched fiber are shown in Table 1. It can be appreciated from Table 1 that the fibers of the present invention prepared in Examples 1 to 3 have adequate mechanical properties, heat stability, dyeability under normal pressure, and dye fastness. On the other hand, the fibers of Comparative Examples 4 to 8 possess inadequate properties.

EXAMPLE 9 TO 11

Polyethylene terephthalate having [η] of 0.65 was extruded from a nozzle having 24 fine holes 0.25 mm at a spinning temperature of 290° C. by using the apparatus shown in FIG. 1. The extruded filaments were passed through a heating cylinder provided at the surface of the nozzle having fine holes, then were subjected to suction and cooled by an aspirator provided at 20 cm from the end of the heating cylinder, further were cooled and solidified by running in air at room temperature, and then, after adding a finishing agent, were wound at predetermined speed. Finally, the fiber of 50 d/24 f was prepared.

The air temperature in the heating cylinder was 200° C. The air was supplied to the aspirator at a temperature of 30° C. and a pressure of 0.5 kg/cm$^2$G, and the amount thereof was 8 Nm$^3$/hr. The microstructure and properties of the fiber for practical use are shown in Table 2. It is clear from the table that the fibers of the present invention satisfy all properties of dyeability, mechanical properties, and heat stability.

TABLE 1

| | | Example | | | | | | | |
|---|---|---|---|---|---|---|---|---|---|
| | | 1 | 2 | 3 | 4 | 5 | 6 | 7 | 8 |
| Spinning speed (m/min.) (stretching ratio) | | 9000 | 8000 | 7000 | 6000 | 5000 | 4000 | 3000 | 1500 (3.3) |
| Dynamic elasticity | T max (°C.) | 102 | 104 | 108 | 114* | 117* | 108 | 90 | 132* |
| | (tan δ) max (—) | 0.126 | 0.129 | 0.134 | 0.182* | 0.234* | 0.251* | 1.722* | 0.110 |
| | tan δ 220 (—) | 0.018 | 0.020 | 0.024 | 0.038 | 0.055 | 0.062 | 0.077 | 0.035 |
| | E'30 (g/d) | 74 | 73 | 59 | 49* | 35* | 24* | 19* | 97 |
| Refractive index | Δn (× $10^{-3}$) | 83 | 108 | 120 | 116 | 86 | 58 | 30 | 173 |
| | $n_{\parallel}$ (o) (—) | 1.660 | 1.677 | 1.682 | 1.673 | 1.641 | 1.611 | 1.583 | 1.691 |
| | $\Delta_{\parallel}$ (0.8–0) (× $10^{-3}$) | 31 | 26 | 15 | 9 | 7 | 5 | 4 | 2 |
| | Refractive index distribution | symmetry | symmetry | symmetry | symmetry | symmetry | symmetry | symmetry | symmetry |
| Crystal structure | Xc (%) | 77 | 75 | 74 | 66 | 33 | 17 | 18 | 58 |
| | ACS (Å) | 65 | 56 | 51 | 36 | — | — | — | 18 |
| | Co (%) | 94 | 94 | 94 | 91 | — | — | — | 90 |
| Mechanical or heat property | Strength (g/b) | 3.5 | 3.8 | 4.3 | 4.1 | 3.6 | 2.7 | 2.1 | 5.0 |
| | Elongation (%) | 25 | 32 | 46 | 62 | 83 | 116 | 193 | 22 |
| | Shrinkage in boiling water (%) | 2.9 | 1.7 | 3.2 | 3.9 | 13.0 | 57.0 | 57.4 | 7.8 |
| | E'220/E'150 | 0.79 | 0.77 | 0.70 | 0.64 | 0.65 | 0.65 | 0.60 | 0.53 |
| Balanced dye absorption (%) | | 89 | 82 | 75 | 52 | 56 | 77 | 82 | 49 |
| Dye fastness | Light fastness | 4~5 | 4~5 | 4~5 | 4~5 | 4~5 | 4~5 | 4~5 | 3 |
| | Friction fastness | 5 | 5 | 5 | 4~5 | 4~5 | 5 | 5 | 4~5 |
| | Hot pressing fastness | 4~5 | 4~5 | 4 | 3~4 | 3 | 3 | 3 | 3 |

(Note) Numbers 1 to 3 are related to the present invention and number 4 to 8 (mark *) are comparative examples.

TABLE 2

| Example | | 9 | 10 | 11 |
|---|---|---|---|---|
| Spinning speed (m/min.) | | 9000 | 8000 | 7000 |
| Dynamic elasticity | T max (°C.) | 101 | 103 | 106 |
| | (tan δ) max (—) | 0.122 | 0.127 | 0.131 |
| | tan δ 220 (—) | 0.017 | 0.018 | 0.022 |
| | E'30 (g/d) | 70 | 72 | 60 |
| Refractive index | Δn (× $10^{-3}$) | 79 | 90 | 107 |
| | $n_{\parallel}$ (0) (—) | 1.658 | 1.671 | 1.678 |
| | $\Delta_{\parallel}$ (0.8–0) (× $10^{-3}$) | 26 | 19 | 13 |
| | Refractive index distribution | symmetry | symmetry | symmetry |
| Crystal structure | Xc (%) | 80 | 77 | 76 |
| | ACS (Å) | 67 | 60 | 55 |
| | Co (%) | 94 | 94 | 94 |
| Mechanical or heat property | Strength (g/d) | 3.4 | 3.8 | 4.0 |
| | Elongation (%) | 24 | 30 | 38 |
| | Shrinkage in boiling water (%) | 2.7 | 2.2 | 2.9 |
| | E'220/E'150 | 0.79 | 0.78 | 0.75 |
| Dyeability | Balanced dye absorption (%) | 90 | 87 | 80 |

TABLE 2-continued

| Example | 9 | 10 | 11 |
|---|---|---|---|
| *Level-dyeing property (Grade) | 1 | 1 | 1 |

*Level-dyeing property was determined as 5 grades such as 1 (no unevenness of dyeing) to 5 (large unevenness of dyeing and unacceptable for practical use) by evaluating dyed sample (cylinderical knitted fabric) with naked eye.

EXAMPLE 12

Polyethylene terephthalate having an inherent viscosity [η] of 0.63, a glass transition temperature of 70° C. and a melting point of 255° C. was extruded from a nozzle having 36 fine holes 0.25 mmϕ at a spinning temperature of 290° C.

The extruded filaments were passed through a heating cylinder, which was provided at a surface of the nozzle having fine holes, having an inside diameter of 15 cm and a length of 20 cm, and further were subjected to suction by an aspirator provided at 20 cm from the end of the heating cylinder using air at room temperature, and a fluid pressure of 1.0 kg/cm$^2$G supplied in an amount of 12 Nm$^3$/hr. The velocity of the filaments exhausted from the aspirator was about 2,000 m/min. calculated based on the denier of the filaments.

Then the filaments were spun at a spinning speed of 7,000 m/min. The results are shown in Table 3, when the temperature of fluid in the heating cylinder was changed. As a reference, the result of a process using only a heating cylinder without an aspirator (No. 7) is shown in the table. As shown in the table, the process of the present invention (Nos. 2, 3, 4, and 5) can be carried out with good spinning stability, and the fibers prepared by the process have adequate properties for practical use and high dye absorption. On the other hand, it was very difficult to carry out the processes of the comparative examples because much fiber filament breaking occurred.

Normal stretched fiber of 70 d/24 f prepared at a spinning speed of 1,500 m/min. and a stretching ratio of 3.2 times had a strength of 5.1 g/d, an elongation of 22%, and a dye absorption of 42%.

TABLE 3

| No. | Temperature of heating zone (°C.) | Spinning stability* | Strength (g/d) | Elongation (%) | Dye absorption (%) |
|---|---|---|---|---|---|
| 1 | 300 | x | — | — | — |
| 2 | 250 | Δ | 4.3 | 37 | 76 |
| 3 | 200 | o | 4.3 | 38 | 78 |
| 4 | 150 | o | 4.1 | 41 | 74 |
| 5 | 90 | Δ | 3.9 | 42 | 70 |
| 6 | 50 | x | — | — | — |
| 7 | 200 | x | — | — | — |

*o Excellent (Fiber breaking and filament breaking cannot be observed.)
Δ Good (Some fiber breaking and filament breaking can be observed.)
x Poor (Many fiber breakings occur and it is difficult to spin.)

EXAMPLE 13

Polyethylene terephthalate employed in Example 12 was extruded from a nozzle having 36 fine holes 0.25 mmϕ at a spinning temperature of 290° C. and spun at a spinning speed of 7,000 m/min. The fiber of 75 d/36 f was prepared. In the process a heating cylinder having an inside diameter of 15 cm was provided at the surface of a nozzle having fine holes and an aspirator was also provided below the heating cylinder. The filaments were subjected to lubrication and crimping treatment before winding. The temperature of the atmosphere inside the heating cylinder was 200° C. The results are shown in Table 4 when the length of the heating cylinder and the distance between the heating cylinder and the aspirator were changed.

Table 4 shows that all examples except Comparative Example No. 12 have good or excellent spinning stability and dyeability, and sufficient strength and elongation for practical use.

TABLE 4

| No. | Length of heating zone (cm) | Distance between the heating zone and the aspirator (cm) | Spinning stability* | Strength (g/d) | Elongation (%) | Dye absorption (%) |
|---|---|---|---|---|---|---|
| 1 | 5 | 20 | Δ | 3.9 | 42 | 71 |
| 2 | 10 | 20 | Δ | 4.1 | 40 | 73 |
| 3 | 20 | 20 | o | 4.3 | 38 | 78 |
| 4 | 40 | 20 | o | 4.3 | 38 | 77 |
| 5 | 80 | 20 | o | 4.3 | 37 | 78 |
| 6 | 20 | 5 | o~Δ | 4.0 | 39 | 77 |
| 7 | 20 | 10 | o | 4.1 | 38 | 76 |
| 8 | 20 | 20 | o | 4.3 | 38 | 78 |
| 9 | 20 | 40 | o | 4.1 | 40 | 75 |
| 10 | 20 | 60 | o~Δ | 4.2 | 37 | 76 |
| 11 | 20 | 80 | Δ | 4.0 | 36 | 75 |
| 12 | 0 | 20 | x | — | — | — |

*o Excellent (Fiber breaking and filament breaking cannot be observed.)
Δ Good (Some fiber breaking and filament breaking can be observed.)
x Poor (Many fiber breakings occur and it is difficult to spin.)

EXAMPLE 14

Polyethylene terephthalate having an inherent viscosity [η] of 0.65 was extruded from a nozzle having 24 fine holes 0.25 mmϕ at 290° C. The extruded filaments were passed through the heating cylinder, which was provided at the surface of the nozzle having fine holes, having an inside diameter of 15 cm and a length of 20 cm, then were subjected to suction and cooled by the aspirator which was provided at 20 cm below the heating cylinder, then were cooled and solidified by running in air at room temperature, and then were wound at a specified speed after a lubrication treatment. Finally the fiber of 50 d/24 f was prepared.

The temperature of air inside the heating cylinder was 200° C. The air was supplied to the aspirator at an air pressure of 0.5 kg/cm$^2$G and a temperature of 30° C. in an amount of 8 Nm$^3$/hr. As a result, spinning stability was excellent at a spinning speed of 4,000 m/min. to 9,000 m/min. The properties of the fiber prepared are shown in Table 5. As a reference, the properties of conventional stretched fiber of 50 d/24 f prepared at a spinning speed of 1,500 m/min., a stretching ratio of 3.0, and a stretching temperature of 60° C. are also shown in the table. In the table, No. 1 is a comparative example outside the present invention, Nos. 3 to 6 are preferred examples, Nos. 4 to 6 are most preferred examples, and No. 7 is a comparative example of conventional stretched fiber. It can be understood from the table that the fibers prepared by the process of the present invention have excellent properties for practical use and excellent dyeability.

TABLE 5

| No. | 1 | 2 | 3 | 4 | 5 | 6 | 7 |
|---|---|---|---|---|---|---|---|
| Spinning speed (m/min.) | 4000 | 5000 | 6000 | 7000 | 8000 | 9000 | 1500 (Stretching ratio 3.0) |

TABLE 5-continued

| No. | 1 | 2 | 3 | 4 | 5 | 6 | 7 |
|---|---|---|---|---|---|---|---|
| Strength (g/d) | 2.5 | 3.6 | 4.2 | 4.0 | 3.8 | 3.4 | 4.9 |
| Elongation (%) | 108 | 74 | 62 | 38 | 30 | 24 | 26 |
| Initial modulus (g/d) | 28 | 39 | 48 | 61 | 71 | 70 | 96 |
| Shrinkage in boiling water (%) | 52.3 | 10.4 | 3.4 | 2.9 | 2.2 | 2.7 | 8.5 |
| Dye absorption (%) | 77 | 61 | 59 | 80 | 87 | 90 | 44 (85)* |
| Dye fastness (light) (Grade) | 4~5 | 4~5 | 4~5 | 4~5 | 4~5 | 4~5 | 3 (5)* |
| Dye fastness (hot pressing) (Grade) | 3 | 3~4 | 3~4 | 4 | 4~5 | 4~5 | 3 (5)* |

*Dye absorption and Dye fastness in dyeing at 130° C.

EXAMPLE 15

The microstructure of fibers Nos. 1 to 6 prepared by Example 14 were observed and are shown in Table 6.

TABLE 6

| No. | 1 | 2 | 3 | 4 | 5 | 6 | 7 |
|---|---|---|---|---|---|---|---|
| T max (°C.) | 109 | 119 | 116 | 106 | 103 | 101 | 130 |
| (tan δ) max (−) | 0.245 | 0.226 | 0.178 | 0.131 | 0.127 | 0.122 | 0.118 |
| *tan δ 220 (−) | 0.061 | 0.049 | 0.037 | 0.022 | 0.018 | 0.017 | 0.037 |
| *E'30 (g/d) | 26 | 38 | 48 | 60 | 72 | 70 | 98 |
| *E'220/E'150 (−) | 0.62 | 0.64 | 0.64 | 0.75 | 0.78 | 0.79 | 0.51 |
| Δn (× $10^{-3}$) | 58 | 90 | 120 | 107 | 90 | 79 | 166 |
| $n_{\parallel}$ (0) (−) | 1.615 | 1.644 | 1.676 | 1.678 | 1.671 | 1.658 | 1.685 |
| $\Delta_{\parallel}$ (0.8-0) (× $10^{-3}$) | 4 | 6 | 7 | 13 | 19 | 26 | 2 |
| Xc (%) | — | — | 69 | 76 | 77 | 80 | 56 |
| ACS (Å) | — | — | 39 | 55 | 60 | 67 | 17 |
| Co (%) | — | 8 | 91 | 94 | 94 | 94 | 86 |

*tan δ 220: tan δ 220° C.
E'30: E' at 30° C.
E'220/E'150: Ratio of E' at 220° C. to E' at 150° C.

EXAMPLE 16

Polybutylene terephthalate having an inherent viscosity [η] of 0.60 was extruded from a nozzle having 24 fine holes 0.25 mmϕ at 280° C. The extruded filaments were passed through a heating cylinder, which was provided at the surface of a nozzle having fine holes, having an inside diameter of 15 cm and a length of 15 cm, then were subjected to suction and cooled with an aspirator which was provided at 30 cm below the heating cylinder, then were cooled and solidified by running in air at room temperature, then where subjected to a lubrication treatment, and then were spun at a spinning speed of 8,000 m/min. Finally the fiber of 75 d/36 f was prepared. The temperature of the atmosphere inside the heating cylinder was 180° C. Air was supplied to the aspirator at a pressure of 0.5 kg/cm$^2$G and a temperature of 25° C. in an amount of 8 Nm$^3$/hr. The process was carried out with good spinning stability. The fiber prepared had a high level of properties such as dyeability, dyeability under normal pressure, dye fastness, and other mechanical properties. The results are shown in Table 7. As a reference, the properties of conventional polybutylene terephthalate fiber (75 d/36 f) prepared by a spinning - stretching process are also shown in the table.

It will be apparent to those skilled in the art that various modifications and variations could be made in the fibers and process of the invention without departing from the scope or spirit of the invention.

TABLE 7

| | Example 16 | Conventional fiber |
|---|---|---|
| Strength (g/d) | 3.5 | 4.5 |
| Elongation (%) | 26 | 28 |
| Initial modulus (%) | 30 | 45 |
| Shrinkage in boiling water (%) | 2.3 | 6.8 |
| Dye absorption (%) | 89 (0.5 hr)* | 85 (1 hr)* |
| Dye fastness (light) (Grade) | 5 | 5 |
| Dye fastness (hot pressing) (Grade) | 5 | 5 |

*Time when the highest dye absorption is attained.

What is claimed is:

1. A process for producing polyester fiber consisting essentially of extruding a melt of polyester, passing the extruded filaments through a heating zone provided at the surface of the nozzle and having a length of at least about 5 cm and a temperature of about 150° C. to about the melting point of the polymer, applying a vacuum with an aspirator located below the heating zone, and then winding at a winding speed of at least about 7,000 m/min.

2. A process according to claim 1, wherein the aspirator has a length of about 5 cm to about 60 cm.

3. A process according to claim 1, wherein the heating zone is kept a temperature of about 150° C. to about a temperature below 15° C. from the melting point of the polyester.

4. A process according to claim 1, wherein the winding speed is at least about 2,300 m/min.

* * * * *